US006814036B2

(12) United States Patent
Palesch et al.

(10) Patent No.: US 6,814,036 B2
(45) Date of Patent: Nov. 9, 2004

(54) VALVE CONTROL FOR ADJUSTING THE STROKE OF VALVES OF MOTOR VEHICLE ENGINES

(75) Inventors: Edwin Palesch, Lenningen (DE); Alfred Trzmiel, Grafenberg (DE)

(73) Assignee: Hydraulik-Ring GmbH, Nürtingen (DE)

( * ) Notice: Subject to any disclaimer, the term of this patent is extended or adjusted under 35 U.S.C. 154(b) by 0 days.

(21) Appl. No.: 10/249,173

(22) Filed: Mar. 20, 2003

(65) Prior Publication Data

US 2003/0177991 A1 Sep. 25, 2003

(30) Foreign Application Priority Data

Mar. 20, 2002 (DE) ..... 102 13 081

(51) Int. Cl.[7] ..... F01L 1/34

(52) U.S. Cl. ..... 123/90.17; 123/90.15; 123/90.31

(58) Field of Search ..... 123/90.17, 90.15, 123/90.31; 92/120–125, 63–76

(56) References Cited

U.S. PATENT DOCUMENTS 2,911,956 A * 11/1959 Smith, Jr. ..... 92/67
5,724,929 A * 3/1998 Mikame et al. ..... 123/90.17

* cited by examiner

*Primary Examiner*—Thomas Denion
*Assistant Examiner*—Zelalem Eshete
(74) *Attorney, Agent, or Firm*—Gudrun E. Huckett

(57) ABSTRACT

A valve control for adjusting a stroke of valves in motor vehicles has at least one adjusting shaft for moving a valve shaft of a valve via at least one transmitting chain. At least one hydraulic drive is provided and acts on the at least one adjusting shaft. The hydraulic drive provides a limited rotation to the at least one adjusting shaft about an axis of the at least one adjusting shaft.

10 Claims, 6 Drawing Sheets

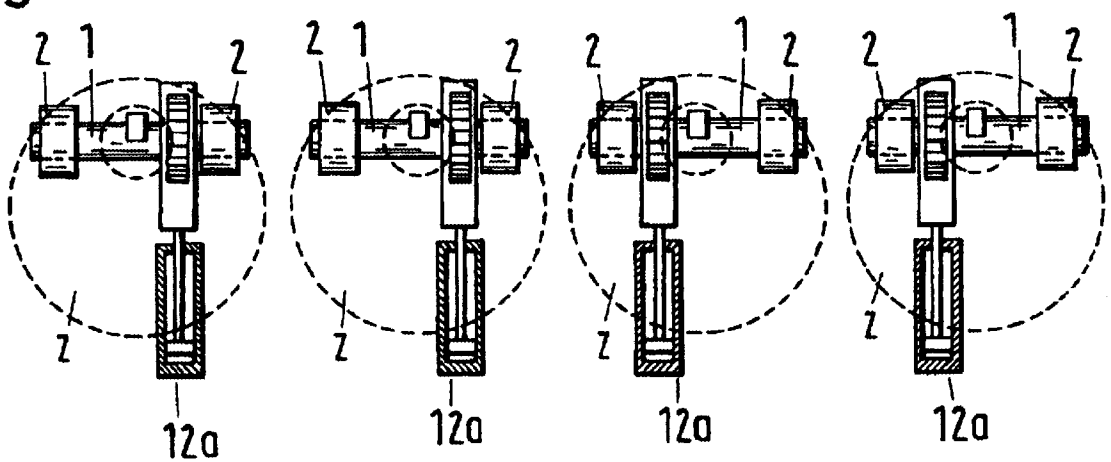
Fig.7
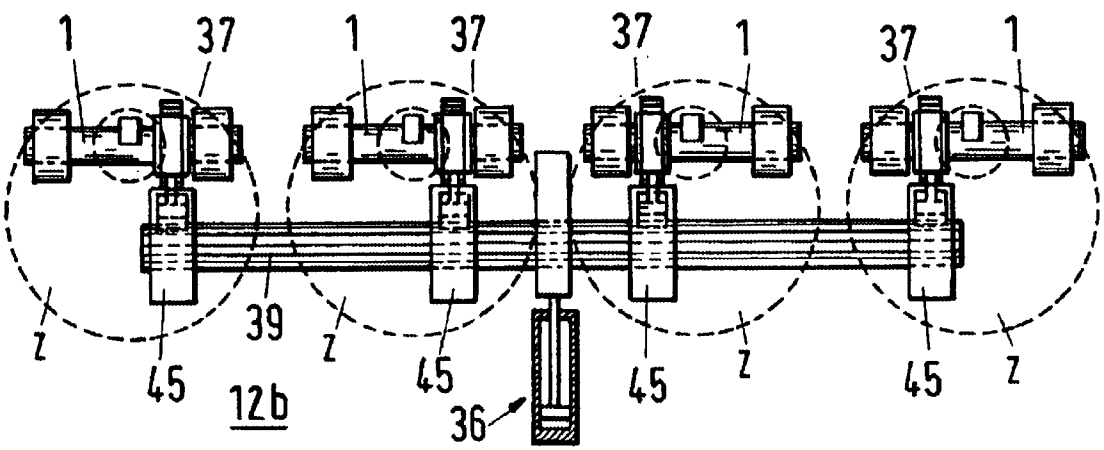
Fig.8
Fig.9
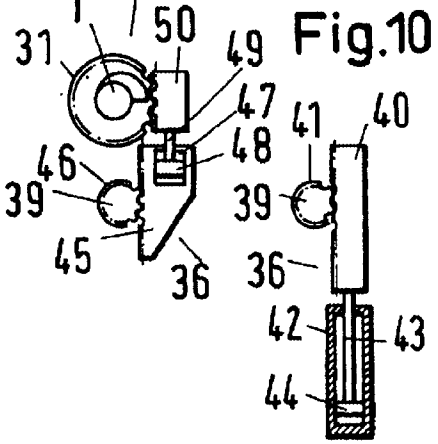
Fig.10

VALVE CONTROL FOR ADJUSTING THE STROKE OF VALVES OF MOTOR VEHICLE ENGINES

BACKGROUND OF INVENTION

1. Field of the Invention

The invention relates to a valve control for adjusting the stroke of valves of a motor vehicle engines, the valve control comprising at least one adjusting shaft with which a valve shaft of the valve can be moved by means of at least one transmitting chain.

2. Description of the Related Art

Valve controls used in connection with internal combustion engines are known which vary the valve stroke in a continuous fashion in order to lower the fuel consumption. The valve controls control the valve stroke as a function of the motor output or power so that always only that amount of fuel is injected into the combustion chamber of the cylinder as required for the momentary output demand. In a known valve control an electric motor is provided whose pinion interacts with an adjusting wheel mounted on an adjusting shaft. By means of this adjusting shaft, the transmission geometry between the camshaft and the valve is changed such that different valve strokes can be adjusted. However, this valve control is extremely complex and accordingly expensive to manufacture.

SUMMARY OF INVENTION

It is an object of the present invention to configure the valve control of the aforementioned kind such that the valve stroke can be adjusted easily while an inexpensive configuration is realized.

In accordance with the present invention, this is achieved in that the adjusting shaft can be rotated about its axis to a limited extent by at least one hydraulic drive.

In the valve control according to the invention, the adjusting shaft is rotated by the hydraulic drive such that the valve stroke can be adjusted as a function of the momentarily required output of the motor. The valve control according to the invention operates preferably completely variably so that within the adjusting range any desired valve stroke can be adjusted. The hydraulic drive can be realized in a simple and inexpensive way and provides a problem-free use.

BRIEF DESCRIPTION OF DRAWINGS

FIG. 7 shows in a representation corresponding to FIG. 1 a fourth embodiment of a valve control according to the invention.

FIG. 8 shows in a representation corresponding to FIG. 1 a fifth embodiment of a valve control according to the invention.

FIG. 9 is a side view of a fine adjusting device of the valve control according to FIG. 8.

FIG. 10 shows a coarse adjusting device of the valve control according to FIG. 8 in a side view.

DETAILED DESCRIPTION

The valve controls to be described in the following enable a completely variable control of the stroke of valves of fuel injection engines. Depending on the required output, the intake valves are opened more or less so that only that amount of air is taken into the combustion chamber of the motor which is required for the momentary output demand. The quantity of fuel corresponding to the provided air quantity is supplied in the way known in the art.

Figure 3:
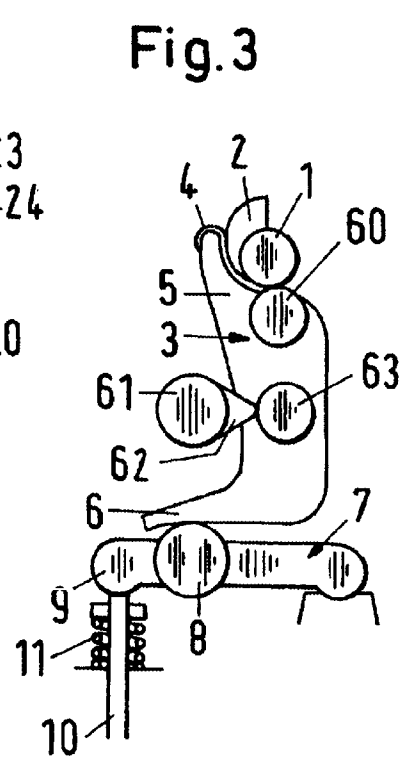
FIG. 3 shows in a side view an adjusting shaft of the valve control according to FIG. 1 which acts by means of an intermediate lever onto a trailing lever.
Figure 2:
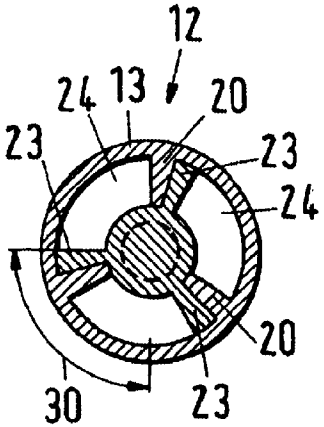
FIG. 2 shows an axial section of a drive of the valve control according to FIG. 1.
Figure 1:
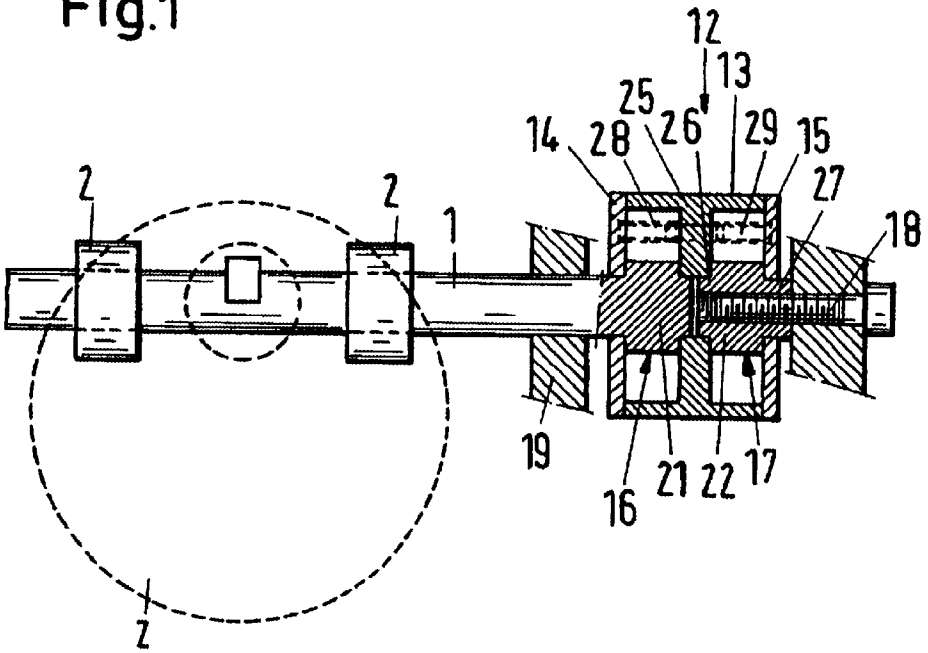
FIG. 1 shows partially in an end view and partially in section a first embodiment of the valve control according to the invention.

The valve control according to FIGS. 1 through 3 has an adjusting shaft 1 on which cams 2 are secured for common rotation with the shaft 1. They act on a two-arm intermediate lever 3 whose one arm 5 rests by means of a roller 4 against the corresponding cam 2. The other arm 6 rests against a roller 8 of a roller lever 7. The intermediate lever 3 additionally supports a further roller 60 resting against the adjusting shaft 1. FIG. 3 also shows the camshaft 61 whose cam 62 rests against a roller 63 of the intermediate lever 3. By means of the cam 62 of the camshaft 61, the intermediate lever 3 is pivoted back and forth as is known in the art. By means of the arm 6, the roller lever 7 is pivoted and, in this way, a valve shaft 10 is moved against the force of at least one pressure spring 11. The lower end (not represented) of the valve shaft 10 supports the valve with which the intake opening into the combustion chamber of the engine cylinder is closed. The valve shaft 10 is moved by the roller lever 7 against the force of at least one pressure spring 11 when the valve is to be opened. The pressure spring 11 ensures that the valve is moved back into its closed position when the roller lever 7 has a corresponding position. The valve control enables to vary the stroke of the valve shaft 10. Since the intermediate lever 3 rests with the roller 4 against the cam 2 of the adjusting shaft 1, the rotation of the adjusting shaft 1 about its axis causes the intermediate lever 3 to pivot to a greater or lesser degree.

When, for example, in the illustration according to FIG. 3, the adjusting shaft 1 is rotated counterclockwise, the intermediate lever 3 is also pivoted counterclockwise because of the contact of the roller 4 on the cam 2. This has the result that the other arm 6 of the intermediate lever 3 adjusts the roller lever 7 correspondingly so that the valve shaft 10, and thus the corresponding valve, carries out a greater stroke. On the other hand, when the adjusting shaft 1 is rotated in the clockwise direction from the position according to FIG. 3, the intermediate lever 3 moves as a result of its contact on the cam 2 also in the clockwise direction. Accordingly, the arm 6 of the roller lever 3 is also adjusted in the clockwise direction. This has the result that the valve shaft 10 carries out a correspondingly smaller stroke.

The adjusting shaft 1 is coupled with a hydraulic drive 12 with which the adjusting shaft 11 can be rotated to a limited extent. It comprises a cylindrical stator 13 (FIG. 2) whose two end faces are closed by cover disks or plates 14, 15. Two rotors 16 and 17 are arranged within the stator 13. The rotor 16 is secured on the adjusting shaft 1 for common rotation. The other rotor 17 is mounted on an axle 18 which is aligned with the adjusting shaft 1 and supported in the cylinder head 19.

Radially inwardly projecting vanes 20 (FIG. 2) project from the inner wall of the stator 13 and are positioned at an angular spacing of 120 degrees relative to one another. The rotors 16, 17 have a cylindrical base member 21, 22 whose axis coincides with the axis of the stator 13. Vanes 23 project radially outwardly from the base member 21, 22. These vanes 23 have also an angular spacing of 120 degrees relative to one another. The rotors 16, 17 are positioned with the end faces of the vanes 23 on the inner wall of the stator 13. The vanes 20 of the stator 13, in turn, rest against the outer wall of the cylindrical base member 21, 22.

As illustrated in FIG. 2, one vane 23 of the rotors 16, 17, respectively, is positioned between two vanes 20 of the stator 13. The vanes 23 of the rotors 16, 17 are loaded, as is known in the art, with hydraulic medium which is supplied by bores (not illustrated) into the chambers 24 of the stator 13. The vanes 23 of the rotors 16, 17 can be loaded on both sides with pressure medium so that the rotors 16, 17 can be rotated in the clockwise direction and counter-clockwise direction relative to the stator 13.

The two rotors 16, 17 are arranged with coinciding axes relative to one another but are not connected to one another. The stator 13 has pressure chambers 24 for both rotors 16, 17, respectively. As illustrated in FIG. 1, the stator 13 has an inner wall and an annular wall 25 projects from the inner wall at half its length. The annular wall 25 has a central through opening 26. The tapering portions of the base members 21, 22 of the rotors 16, 17 project into this through opening 26. The annular wall 25 is positioned with the edge of the through opening 26 sealingly on the tapering end sections of the base members 21, 22 of the rotors 16, 17. Moreover, the base members 21, 22, as shown in FIG. 1, are sealingly positioned on the facing inner sides of the annular wall 25 and the cover plates 14, 15. In the illustrated embodiment, the rotor 16 is formed as a monolithic part of the adjusting shaft 1. However, it can also be a separate component connected to the adjusting shaft 1. The adjusting shaft 1 projects through the cover plate 14 and is sealed relative to the cover plate 14.

The rotor 17 projects with its tapering end section 27 sealingly through the cover plate 15 and rests with its end face on the wall of a cylinder head 19. The rotor 17 has a central through opening in which the axle 18 is inserted.

The two rotors 16, 17 are rotated independently from one another because they are arranged with their vanes 23 in separate chambers 24 of the stator 13. The cover plates 14, 15 are connected detachably by screws 28, 29 on the annular wall 25.

The rotors 16, 17 can be rotated about their axes until their vanes 23 come to rest against the vanes 20 of the stator 13. FIG. 2 shows in an exemplary fashion that the maximum adjusting angle 30 of the rotors 16, 17 is 90 degrees.

Since the two rotors 16, 17 are rotatable by 90 degrees in the illustrated embodiment and are coupled with one another, the adjusting shaft 1 can be rotated maximally about 180 degrees. The pressure chambers 24 for the two rotors 16, 17 are loaded by a hydraulic medium, respectively. The rotor 16 on the adjusting shaft is positioned in the initial position such that its vanes 23 rest against the vanes 20 of the stator 13. The vanes 23 of the rotor 17 also rest against the stator vanes 20. Both rotors 16, 17 are however rotated relative to one another such that their vanes rest against different stator vanes 20, viewed in the axial direction of the rotary hydraulic drive 12.

The pressure chambers 24 for the stator 13 are initially kept under pressure by means of the hydraulic medium so that the rotary vanes 23 rest against the stator vanes 20 under the pressure of the hydraulic medium. In the pressure chambers 24 for the other rotor 17, the hydraulic medium is introduced under pressure such that the stator 13 is rotated relative to the rotor 17. The other rotor 16 rests with its vanes 23 on the stator vanes 20 such that the stator 13 entrains this rotor 16 upon relative rotation. In this way, the adjusting shaft 1 is rotated about its axis.

In order for the relative rotation between the stator 13 and the rotor 17 to take place, the vanes 23 of the rotor 17 are loaded on one side with the pressure of the hydraulic medium while the side of the pressure chambers 24 delimited by the other side of the rotor-vane 23 is relieved from the hydraulic pressure, respectively. As soon as the vanes 23 of the rotor 17 rests against the stator vanes 20, the hydraulic medium is kept at a pressure such that this contact position is maintained. At the same time, the hydraulic control for the rotor 16 is switched such that the rotor 16 now can rotate relative to the stator 13. For this purpose, the rotary vanes 23 are loaded on one side with the pressurized hydraulic medium while the part of the pressure chambers 24 delimited by the other side of the rotary vanes 23 is pressure-relieved. In this way, the adjusting shaft 1 is rotated twice by 90 degrees, i.e., is rotated maximally about its axis by a total amount of 180 degrees.

When the adjusting shaft 1 is rotated such that the arm 5 of the intermediate lever 3 rests in the area adjacent to the cams 2 on the peripheral surface of the adjusting shaft 1, the roller lever 7 is pivoted back to such an extent that the valve shaft 10 is not actuated. As soon as the adjusting shaft 1 is rotated and the roller 4 of the arm 5 of the intermediate lever 3 reaches the outer surface of the corresponding cam 2, the intermediate lever 3 is pivoted counterclockwise in FIG. 3. By means of the arm 6 the roller lever 7 is also pivoted counterclockwise. Since the arm 9 of the roller lever 7 acts on to the valve shaft 10, the valve shaft 10 is moved downwardly to a greater or lesser extent, depending on the rotary angle of the adjusting shaft 1, and, in this way, the stroke of the valve is adjusted according to the engine output demand.

Since the drive 12 is actuated hydraulically, the intake valves can be returned into their initial position when the motor vehicle engine is turned off. The intake valves return into a position in which they open the smallest intake opening. The described fully variable valve control is inexpensive and, moreover, has a simple configuration.

Figure 4:
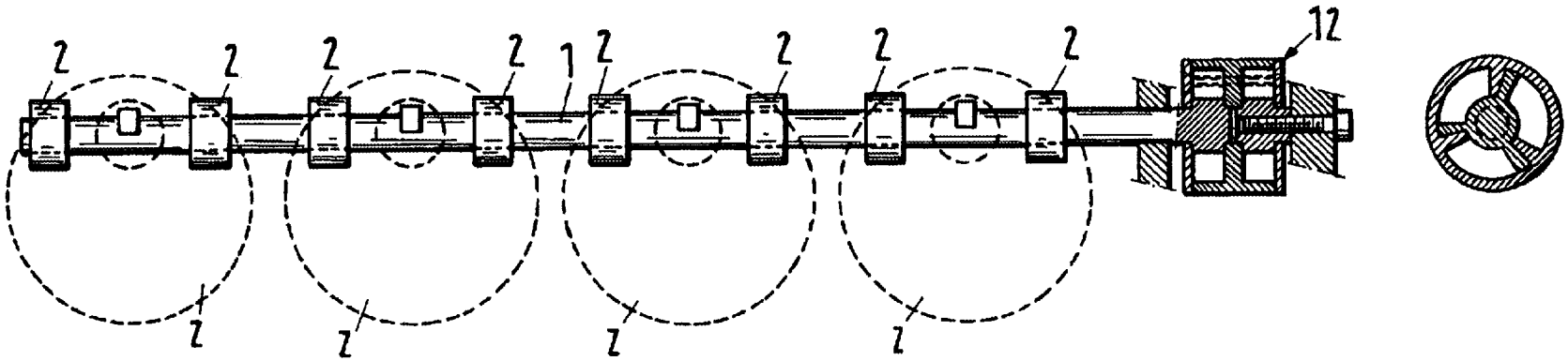
FIG. 4 shows in a representation corresponding to FIG. 1 a second embodiment of a valve control according to the invention.

FIG. 4 shows that with the adjusting shaft 1 and the rotary hydraulic drive 12 several intake valves can be actuated simultaneously. On the adjusting shaft 1 there are several cams 2 provided that are positioned at a spacing to one another and act via the intermediate drive according to FIG. 3 on the corresponding valve shafts, respectively. With the single rotary drive 12 according to this embodiment eight cams 2 can be actuated which act on corresponding valve shafts and, depending on the rotary position of the adjusting shaft 1, control the stroke of the valve.

Figure 6:
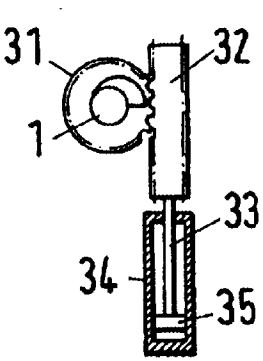
FIG. 6 is a side view of the valve control of FIG. 5.
Figure 5:
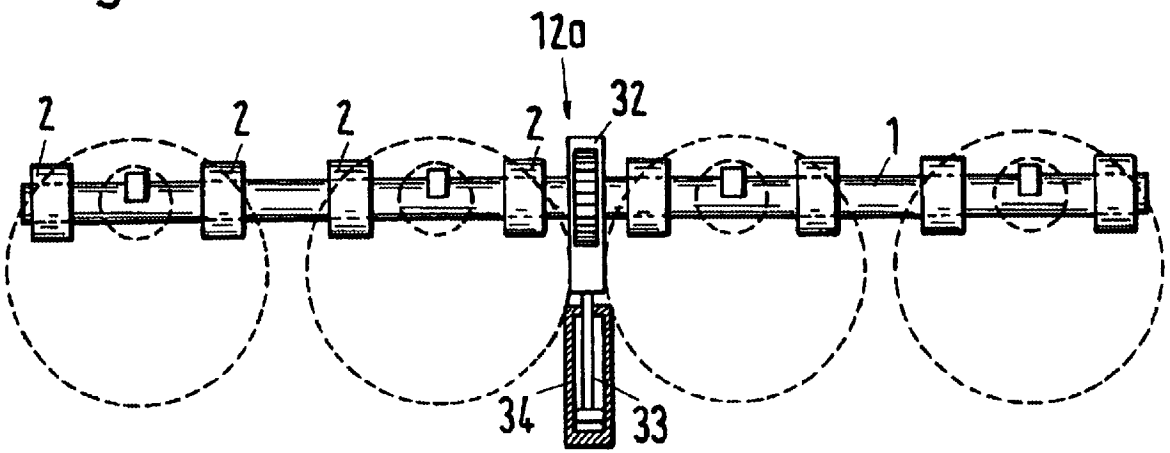
FIG. 5 in a representation corresponding to FIG. 1 a third embodiment of the valve control according to the invention.

In the embodiment according to FIGS. 5 and 6, the adjusting shaft 1, on which eight cams 2 are provided in accordance with the preceding embodiment, is no longer rotatably driven from one end but is rotated at a location at half its length. The adjusting shaft 1 in the shown embodiment has at half its length a circumferential outer toothing 31 engaged by a toothed rack 32 of the hydraulic drive 12*a* for rotating the shaft 1. The hydraulic drive 12*a* thus is a sliding or linear drive. The toothed rack 32 is positioned on a piston rod 33 which projects from a cylinder 34. The piston rod 33 supports within the cylinder 34 a piston 35 which is sealingly moveable within the cylinder 34 by means of a hydraulic medium. The linear extension and retraction of the piston rod 33 rotates the adjusting shaft 1 by means of the toothed rack 32 in the corresponding direction. Via the cam 2 and the corresponding transmitting chain according to FIG. 3, respectively, the corresponding valve shaft is adjusted and, in this way, the stroke of the intake valve is controlled.

This embodiment is characterized by its configurational simplicity. The toothed rack drive ensures a precise continuous rotation of the adjusting shaft 1 so that the stroke of the intake valves can be adjusted correspondingly in a continuous fashion.

In the embodiment according to FIG. 7, each motor cylinder Z has a separate hydraulic drive 12*a* which is embodied corresponding to the embodiment of FIGS. 5 and 6. Accordingly, this completely variable valve control has four adjusting shafts 1 with two cams 2 each.-In this way, the intake valves can be variably adjusted relative to one another in that the respective adjusting shaft 1 is rotated about its axis by the desired amount by means of the hydraulic drive 12*a*. The rotary drives 12*a* are supplied independently from one another with hydraulic medium so that a problem-free and reliable adjustment of the respective intake valves is ensured.

In the embodiment according to FIGS. 8 through 10, the drive 12*b* has of coarse adjusting device 36 as well as fine adjusting devices 37. By means of the coarse adjusting device 36, the fine adjusting devices 37, which are provided individually for each intake valve in accordance with the embodiment of FIG. 7, are actuated together. By means of the fine adjusting devices 37 individual adjusting shafts 1 can then be fine-adjusted by the required amount in order to adjust the individual stroke of the intake valves.

The coarse adjusting device 36 has a drive 38 with which an intermediate shaft 39 can be driven in rotation. The shaft 39 is positioned parallel to the adjusting shafts 1, which are aligned with one another, and has an outer toothing 41 in the area of a toothed rack 40; the outer toothing 41 is engaged by the toothed rack 40. The toothed rack 40 is connected to one end of a piston rod 43 projecting from the cylinder 42. It supports on the other end a piston 44 which is guided sealingly within the cylinder 42. By loading the piston 44 with a hydraulic medium, the piston rod 43 can be extended and retracted so that intermediate shaft 39 can be rotated by the toothed rack 40 in the desired direction.

By means of the intermediate shaft 39, supports 45 can be moved. The supports 45 are formed as a toothed rack and engage a corresponding outer toothing 46 of the intermediate shaft 39. When the intermediate shaft 39 is rotated by the toothed rack 40 about its axis, the supports 45 are moved accordingly.

The supports 45 which are correlated with the intake valves are of identical configuration and have a pressure chamber 47 in which a piston 48 is moveable. The piston 48 is seated on the free end of a piston rod 49 which projects from the support 45 and supports, in turn, a toothed rack 50. The toothed rack 50 engages the outer toothing 31 of the corresponding adjusting shaft 1.

By actuating the drive 38 to 44 (FIG. 10), first the intermediate shaft 39 is rotated about its axis so that the supports 45 engaged by it are moved, depending on the rotational direction, in the direction of the adjusting shaft 1 or away from it. In this way, a coarse adjustment of the stroke of the intake valve of the motor cylinder Z takes place. Subsequently, by means of the fine adjusting devices 37 the valve shafts 10 of the intake valves can be adjusted independently from one another in their exact position so that the corresponding intake valves perform their own optimal stroke. For this purpose, the piston rods 49 of the supports 45 are extended and retracted so that by means of the toothed racks 50 the adjusting shafts 1 are rotated in the described away about their axes. By means of the cams 2 on the adjusting shafts 1, intermediate levers 3 (FIG. 3) are pivoted in the described way so that the roller lever 7 is pivoted correspondingly. In this way, the valve shafts 10 of the intake valves are moved into their required position. By means of the fine adjusting devices 37, the intake valves can be adjusted such that knocking of the engine does not occur.

Figure 12:
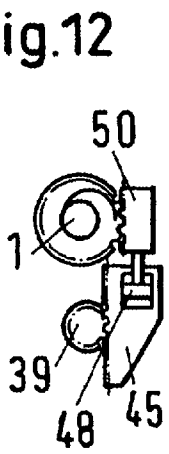
FIG. 12 shows a side view of the valve control according to FIG. 11.
Figure 11:
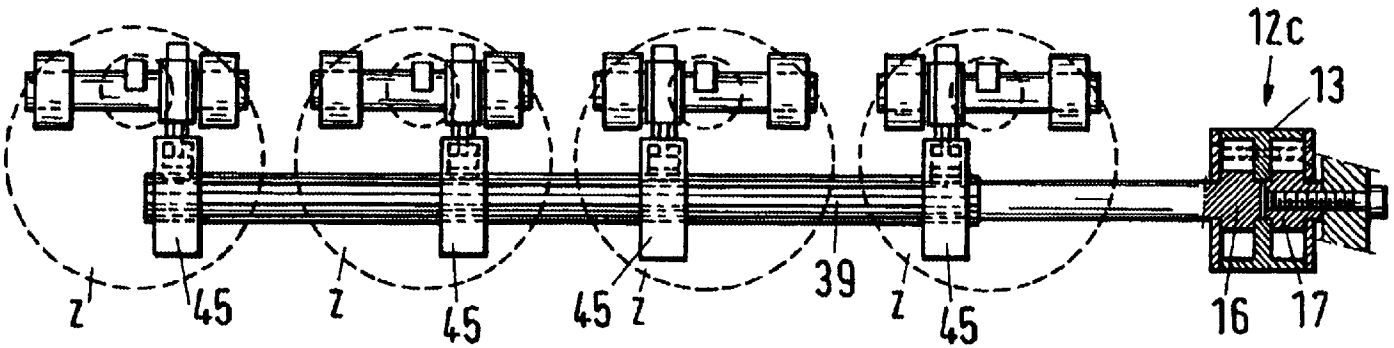
FIG. 11 shows in a representation corresponding to FIG. 1 a sixth embodiment of a valve control according to the invention.

The embodiment according to FIGS. 11 and 12 is substantially configured as described in connection with embodiment FIGS. 8 through 10. Only the drive 12*c* has a different configuration in comparison to the preceding embodiment. This drive 12*c* has the same configuration as the drive 12 of FIGS. 1 through 3. The rotor 16 is provided at one end of the intermediate shaft 39, advantageously as a monolithic part thereof. The drive 12*c* is otherwise configured in the same way as the hydraulic drive 12 for FIGS. 1 to 3. By means of the two rotors 16, 17 arranged in the stator 13, the intermediate shaft 39 can be rotated maximally by 180 degrees about its axis. This rotary movement of intermediate shaft 39 is transmitted onto the supports 45 which, in accordance with the preceding embodiment, are moved perpendicularly to the axis of the adjusting shafts 1. By means of the toothed racks 50, the adjusting shafts 1 are rotated by the corresponding amount about their axes. In addition, by means of the fine adjusting devices 37, a fine adjustment of the stroke of each intake valve of the motor cylinder Z is possible. As in the preceding embodiment, during the course of coarse adjustment by means of the stators 13 and the two rotors 16, 17, the pistons 48 of the fine adjusting devices 37 are maintained in their positions, respectively, because of a corresponding pressure loading. Only when the coarse adjustment is complete, the fine adjusting devices, if needed, are actuated in that the pistons 48 are loaded with hydraulic medium and the fine adjusting device are moved in the desired direction.

Figure 14:
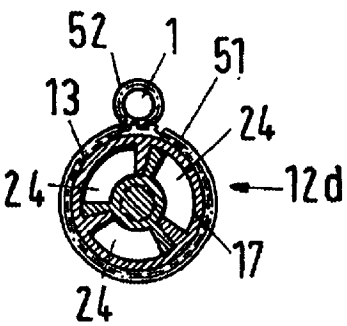
FIG. 14 is a side view of the valve control according to FIG. 13.
Figure 13:
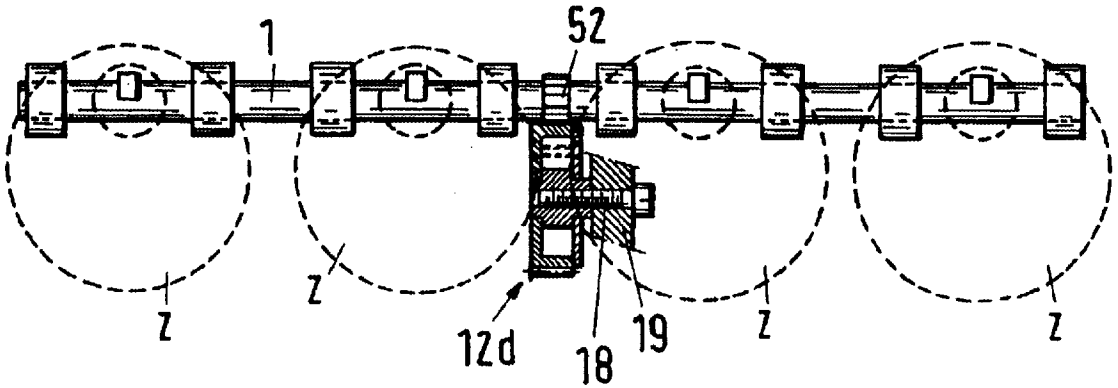
FIG. 13 shows in a representation corresponding to FIG. 1 a seventh embodiment of the valve control according to the invention.

In the embodiment according to FIGS. 13 and 14, a common adjusting shaft 1 is provided for the intake valves of the motor cylinder Z. Accordingly, the valve shafts 10 (FIG. 3) of the intake valves can be moved only together. For driving the adjusting shaft 1, a drive 12*d* is provided. It comprises a cylindrical stator 13 in which the rotor 17 is rotatably supported. It is seated on the axle 18 which is supported in the cylinder head 19 (FIG. 13). The hydraulic medium is introduced into the pressure chambers 24 of the stator 13. In this way, the stator 13 is rotated relative to the rotor 17 in the described way. The stator 13 has an outer toothing 51 on its peripheral surface which is engaged by the outer toothing 52 of the adjusting shaft 1. In this way, the adjusting shaft 1 is rotated by the required amount. In contrast to the embodiment of FIGS. 1 through 3, the rotary angle of the stator 13 is only 90 degrees. For this reason, the transmission ratio between the toothing 51 of the stator 13 and the outer toothing 52 of the adjusting shaft 1 is selected such that the adjusting shaft is rotated about 180 degrees for a rotary angle of 90 degrees of the stator 13. The transmission of the rotation of the adjusting shaft 1 onto the valve shafts 10 is realized by means of an intermediate gear which has described in connection with FIG. 3.

Figure 16:
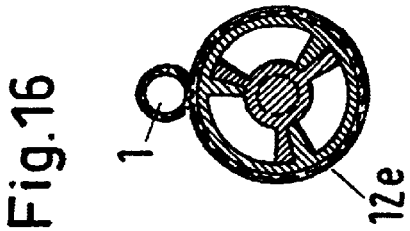
FIG. 16 is a side view of the valve control according to FIG. 15.
Figure 15:
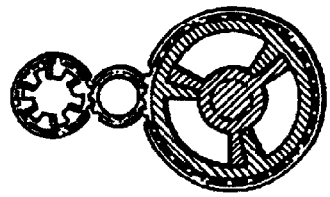
FIG. 15 is a representation corresponding to FIG. 1 of an eighth embodiment of the valve control according to the invention.
Figure 15:
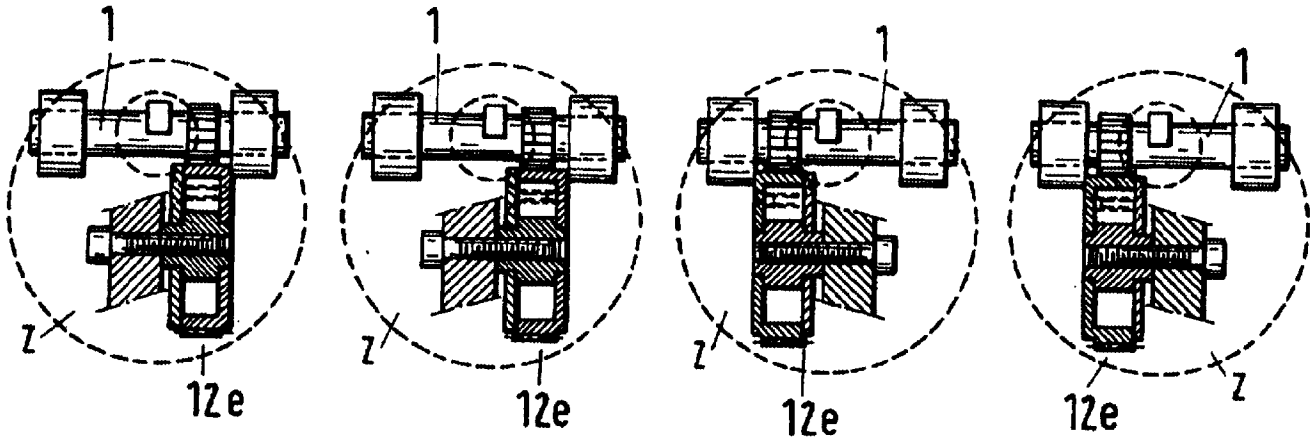

In contrast to the preceding embodiment, in the embodiment of FIGS. 15 and 16, each intake valve of the motor cylinders is provided with an adjusting shaft 1. In this way, each adjusting shaft 1 has correlated therewith a hydraulic drive 12*e*. The hydraulic drive 12*e* is identical to the hydraulic drive 12*d* according to FIGS. 13 and 14. By means of the rotary drives 12*e*, the adjusting shafts 1 can be rotated independently from one another by the required amount. The valve shafts of the intake valves of the motor cylinders Z can be optimally moved independently from one another.

Figure 17:
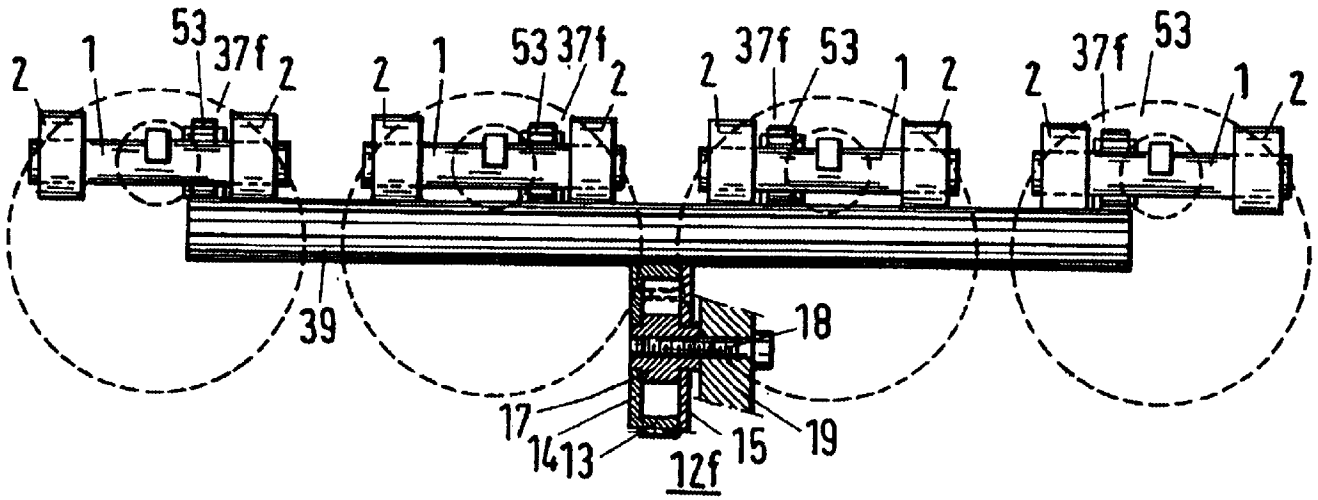
FIG. 17 shows in a representation corresponding to FIG. 1 a ninth embodiment of a valve control according to the invention.
Figure 19:
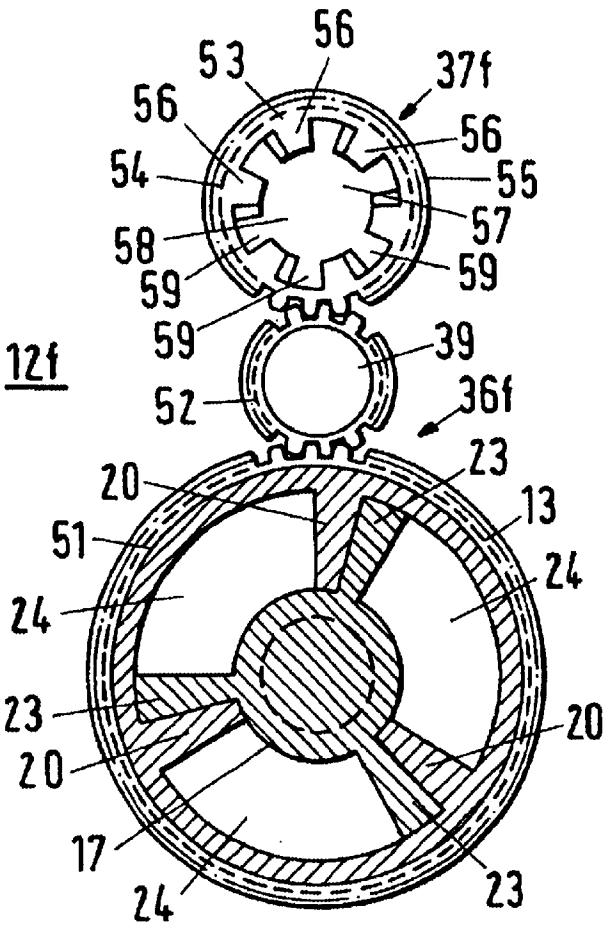
FIG. 19 shows an axial section of a coarse adjusting device of the valve control according to FIG. 17.
Figure 18:
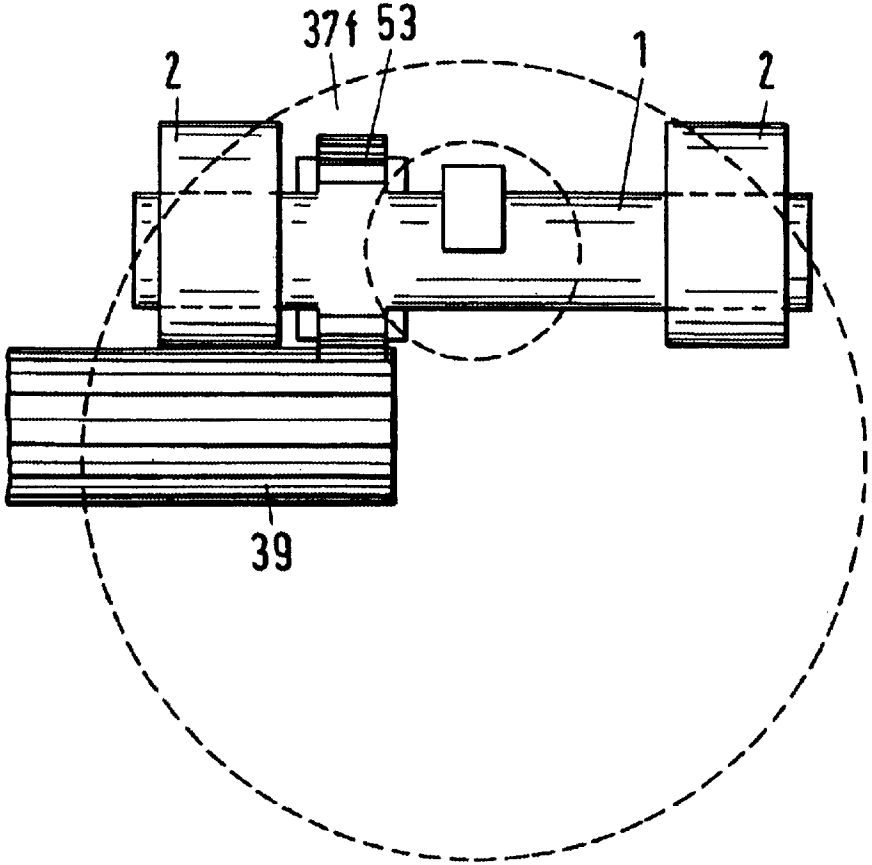
FIG. 18 shows in an enlarged representation a fine adjusting device of the valve control according to FIG. 17.

FIGS. 17 through 19 shows a rotary hydraulic drive 12*f* which, similar to the embodiment of FIGS. 8 through 10, is provided with a coarse adjusting device 36*f* and fine adjusting devices 37*f* for the individual adjusting shafts 1. The coarse adjusting device 36*f* comprises a stator 13 in which the rotor 17 is arranged. It is seated on the axle 18 that is mounted in the cylinder head 19. As in the embodiments of FIGS. 13 to 16, the stator 13 is covered at its end faces by the cover plates 14, 15. The stator 13 has an outer toothing 51. The hydraulic medium is introduced into the pressure chambers 24 of the stator 13 such that the stator 13 is rotated relative to the rotor 17. The maximum rotary angle of the stator 13 in this embodiment is 90 degrees.

The outer toothing 52 of the intermediate shaft 39 engages the outer toothing 51 of the stator 13. Four swivel motors 53 mesh with the outer toothing 52 of the intermediate shaft 39 and are seated on an adjusting shaft 1, respectively, and belong to the fine adjusting devices 37*f*. Each swivel motor 53 has an outer ring 54 (FIG. 19) which is provided with an outer toothing 55 with which the outer ring 54 engages the outer toothing 52 of the intermediate shaft 39. Radially inwardly projecting vanes 56 project from the inner wall of the outer ring 54 and rest with their end faces against a cylindrical base member 57 of the rotor 58. It has radially outwardly oriented vanes 59 which rest with their end faces on the inner wall of the outer ring 54. The rotor 58 can be rotated by a minimal angle of rotation within the outer ring 54 until its vanes 59 contact the lateral surfaces of one of the neighboring vanes 56 of the outer ring 54. The rotor 58 is fixedly connected with the adjusting shaft 1, respectively. Between the vanes 56, 59 of the outer ring 54 and the rotor 58, hydraulic medium is introduced under pressure so that the relative rotation of the rotor 58 relative to the outer ring 54 can be carried out.

In the shown embodiment, four aligned adjusting shaft 1 are provided on which, according to the embodiment of FIGS. 7 and 11 to 16, two cams positioned at an axial spacing to one another are provided. With these cams, the valve shafts 10 (FIG. 3) of the intake valves are actuated, as has been explained in detail in connection with FIG. 3.

With the coarse adjusting device 36*f* of the rotor drive 12*f*, first all adjusting shafts 1 are simultaneously rotated about the same angle. For this purpose, the hydraulic medium under pressure is introduced into the pressure chambers 24 so that the stator 13 is rotated relative to the rotor 17 to such an extent that the rotor vanes 20 come to rest against the stator vanes 23. By means of the intermediate shaft 39, the outer rings 54 of the swivel motors 53 meshing with the shaft 39 are rotated about their axis. During this coarse adjustment, the vanes 56 of the outer ring 53 are secured by pressure loading in contact against the rotor vanes 59 so that the rotation of the outer ring 54 entrains the rotor 58 in the same rotary direction. In this way, adjusting shafts 1 are rotated by the same amount about their axis by means of the coarse adjusting device 36*f*. Subsequently, the adjusting shafts 1 can be rotated independent from one another by means of the fine adjusting devices 37*f* by a small angle. Starting from the position according to FIG. 19, for example, the pressure chamber between the rotor vanes 59 and the vanes 56 of the outer ring 54 are relieved while the hydraulic medium is introduced under pressure into the region between the contacting vanes 56, 59. In this way, the rotor 58 is slightly rotated in the clockwise direction relative to the outer ring 54. Since the rotors 58 are fixedly attached to the corresponding adjusting shafts 1, these adjusting shafts are further rotated by a small angle. During this rotary movement, the pressure chambers 24 of the stator 13 are pressurized such that a relative rotation between the stator 13 and the rotor 17 cannot take place.

In the illustrated embodiments two intake valves are provided for each cylinder of the motor. Depending on the type of motor, more than two intake valves per cylinder can be provided. In the simplest scenario, each cylinder has only one intake valve.

The valve controls have been described with the aid of the illustrated embodiments for controlling the stroke of intake valves. The valve controls, of course, can also be used in the same way for exhaust valves in order to change their stroke as desired.

In the described embodiments the adjusting shaft 1 is provided with cams 2, respectively. However, in all embodiments the adjusting shaft 1 can be, for example, an eccentric shaft so that no cams are required. Important for the adjusting shaft is that its rotation generates a transverse or radial component which is used for moving the valve shaft 10 by means of the transmitting chain by the desired amount. The transmitting chain must not be formed by mechanical components, as described in connection with in the embodiment illustrated in FIG. 3, but can be configured, for example, as a hydraulic transmitting chain. It must only be ensured that the normal stroke of the valve shaft 10 generated by the camshaft of the motor can be varied by means of the adjusting shaft 1.

While specific embodiments of the invention have been shown and described in detail to illustrate the inventive principles, it will be understood that the invention may be embodied otherwise without departing from such principles.

What is claimed is:

1. A valve control for adjusting a stroke of valves in a motor vehicle engine, the valve control comprising:

at least one adjusting shaft adapted to move a valve shaft of a valve via at least one transmitting chain;

a hydraulic drive acting on the at least one adjusting shaft and adapted to provide a limited rotation to the at least one adjusting shaft about an axis of the at least one adjusting shaft;

wherein the hydraulic drive is a rotary drive;

wherein the hydraulic drive comprises a stator and two rotors arranged in the stator, wherein the stator is rotatable relative to the two rotors;

wherein the two rotors are positioned adjacent to one another within the stator and are separated from one another.

2. The valve control according to claim 1, wherein a first one of the two rotors is fixedly connected to the at least one adjusting shaft.

3. The valve control according to claim 1, wherein the stator is cylindrical.

4. The valve control according to claim 1, wherein the stator has an inner wall and stator vanes connected to the inner wall, wherein the stator vanes project from the inner wall, wherein the two rotors each have a base member provided with radially projecting rotor vanes, wherein the rotor vanes are positioned between the stator vanes.

5. The valve control according to claim 4, wherein the rotor vanes and the stator vanes are rotatable relative to one another to a limited extent.

6. The valve control according to claim 1, wherein a first one of the two rotors is arranged on the at least one adjusting shaft and wherein the stator is rotated by pressure loading and entrains the first rotor while the stator is rotated relative to a second one the two rotors to a limited extent.

7. The valve control according to claim 6, wherein the first rotor is adapted to rotate to a limited extent relative to the stator under pressure loading.

8. The valve control according to claim 1, wherein the at least one adjusting shaft has at least one cam.

9. The valve control according to claim 1, wherein the at least one adjusting shaft has several cams adapted to control several valves.

10. The valve control according to claim 1, wherein several of the at least one adjusting shafts are provided so that each cylinder of a motor vehicle engine has one of the adjusting shafts interacting with the cylinder.

* * * * *